United States Patent [19]

Braugh

[11] Patent Number: 4,781,387

[45] Date of Patent: Nov. 1, 1988

[54] METAL TO METAL SUBSEA CASING HANGER SEAL

[76] Inventor: Benton F. Baugh, 11626 Oak Bend,

[21] Appl. No.: 61,587

[22] Filed: Jun. 15, 1987

[51] Int. Cl.[4] ..... F16J 15/00; E21B 43/013; F16L 35/00

[52] U.S. Cl. ..... 277/12; 277/235 R; 166/88; 166/348; 166/382; 285/18; 285/140

[58] Field of Search ..... 277/1, 12, 4, 58, 208–210, 277/236, 227, 228, 235 R; 166/82, 84, 88, 348, 382; 285/18, 140, 142, 147, 95, 338, 339, 348

[56] References Cited

U.S. PATENT DOCUMENTS

| | | | |
|---|---|---|---|
| 4,521,040 | 6/1985 | Slyker et al. | 285/140 |
| 4,540,053 | 9/1985 | Baugh et al. | 166/382 X |
| 4,564,068 | 1/1986 | Baugh | 166/348 X |
| 4,634,152 | 1/1987 | Pettit | 285/140 X |

*Primary Examiner*—David Werner

[57] ABSTRACT

A seal assembly for providing reliable sealing between a subsea wellhead and a casing hanger suspended within the wellhead which provides a metal band between the top and the bottom of the seal section for strength, setting force acting against the portion of the seal outside of the metal band, collapsing of the metal band by pressure generated in the portion of the seal, and the movement of the metal band setting the seal within the seal onto the casing hanger.

18 Claims, 2 Drawing Sheets

METAL TO METAL SUBSEA CASING HANGER SEAL

INFORMATION DISCLOSURE STATEMENT

No formal search has been done with respect to this application.

The following patents are in the general nature of the present invention: U.S. Pat. Nos. 3,649,032, 3,797,864, 3,837,684, 4,448,740, 4,540,053, 4,597,448, 4,615,544.

BACKGROUND OF THE INVENTION

The field of this invention relates to the seals which are used to seal between the casing hanger supporting casing in a wellhead and the wellhead in which the casing hanger is landed. The casing hanger and wellhead are used in the drilling and production of oil and gas from the formations of the earth, both on land and on the ocean floor.

A need has existed as oil and gas wells have been drilled into formations of progressively higher pressure and in deeper and deeper ocean waters for casing hangers which provide highly reliable metal to metal sealing between the casing hangers and wellhead. Additionally the casing hanger seal means needs to be protected from damage as it is travelling down thru a central riser pipe from the surface of the water to the mudline.

Several designs have been addressed to this area, most sharing the deficiencies of difficulties of unreliable sealing characteristics, difficulties in achieving a high enough pressure in the seal element to reliably seal against well bore pressures, service problems in retrieving the entire seal assembly when the seal has not sealed properly, and presetting of the seal going into the well bore.

The most common defect in the retrieval of the seals is that of the seal assemblies separating during the retrieval process as the top and the bottom of the seal assembly are connected in some cases only by rubber seal elements.

SUMMARY OF THE INVENTION

The object of the present invention is to provide a seal means for a casing hanger which is energized by a force down against a shoulder which causes a first section of the metal seal to be energized in a fashion to increase its radial dimension, and the interference caused by the increase in radial dimension causing a second portion of the metal seal to be energized.

Another benefit of this seal and its means of energization is that the movement of the setting shoulder in relationship to the seal can be prevented prior to the seal being moved into its correct relationship with respect to the casing hanger and wellhead, thereby effectively preventing the potential problems of presetting the seal element.

A further benefit of this seal is that resilient seals can be easily contained within the metal portions of the seal and give additional sealing capabilities as backup seals, or in some cases as the primary seal. Further benefit to the reliability of the resilient seal means is that the metal to metal seal provides an excellent means of closing possible extrusion gaps for the resilient seals, preventing potential extrusion of the resilient seal under higher pressures.

An additional benefit provided by the present invention is that a solid metal link or band is provided from the top to the bottom of the seal to insure the ability to retrieve the complete seal assembly during service or abandonment operations.

BRIEF DESCRIPTION OF THE DRAWINGS

FIG. No. 1 is a general view of a subsea drilling and wellhead system which would take advantage of this type casing hanger seal concept.

FIG. No. 2 shows a half section of the casing hanger seal of the present invention as it would be run and landed on a casing hanger in a wellhead, and prior to setting the seal FIG. No. 3 shows a half section the casing hanger seal as it would be after the seal has been energized and is sealing between the casing hanger and the wellhead.

FIG. No. 4 shows a half section of the seal section of a casing hanger seal assembly which utilizes only metal to metal seals.

DESCRIPTION OF THE PREFERRED EMBODIMENT

The present invention is a system for sealing a casing hanger within a wellhead in an oil or gas well. Although the present invention may be used in a variety of environments, FIG. 1 is a diagrammatic illustration of a typical installation of a casing hanger and a casing string of the present invention in a wellhead disposed on the ocean floor of an offshore well.

Figure 1:
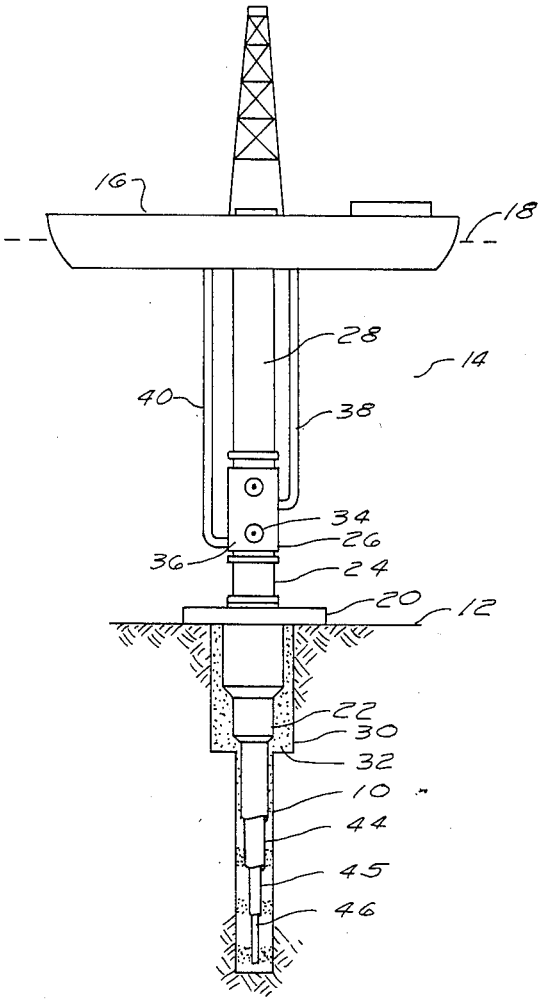
Figure 4:
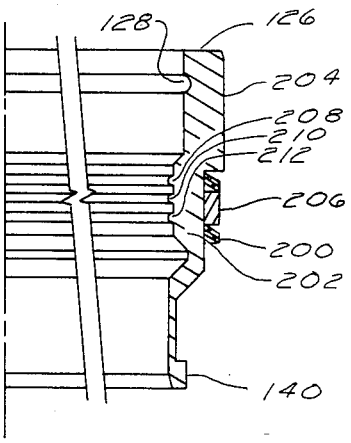

Referring initially to FIG. 1, there is shown a well bore 10 drilled into the ocean floor 12 below a body of water 14 from a drilling vessel 16 floating at the surface 18 of the water. A base structure or guide base 20, a conductor casing 22, a wellhead 24, a blowout preventer stack 26 with pressure control equipment, and a marine riser 28 are lowered from floating drilling vessel 16 and installed on or near the ocean floor 12. Conductor casing 22 may be driven or jetted into the ocean floor until wellhead 24 rests near the ocean floor 12, or as shown in FIG. 1, a bore hole 30 may be drilled for the insertion of conductor casing 22.

Guide base 20 is secured about the upper end of conductor casing 22 on the ocean floor 12, and conductor casing 22 is anchored within bore hole 30 by column 32 of cement about a substantial portion of its length. Blowout preventer stack 26 is releasably connected through a suitable connection to wellhead 24 disposed on guide base 20 mounted on sea floor 12 and includes one or more blowout preventers such as blowout preventer 34. Such blowout preventers include a number of sealing pipe rams, such as pipe ram 36 on blowout preventer 34, adapted to be actuated to and from the blowout preventer into and from sealing engagement with a tubular member, such as drill pipe, extending through blowout preventer 34, as is well known in the art. Marine riser pipe 28 extends from the top of the blowout preventer stack 26 to floating vessel 16.

Blowout preventer 26 includes "choke and kill" lines 38 and 40 respectively, extending to the surface 18. Choke and kill lines are used for among other things to test pipe rams 36 of blowout preventer 34.

Drill bits are used to drill the well bore 10 through the blowout preventer stack 34 progressively deeper into the formations of the earth and casing strings such as 44 thru 46 are inserted into the well bore 10 and are suspended from casing hangers within the wellhead 24.

Figure 2:
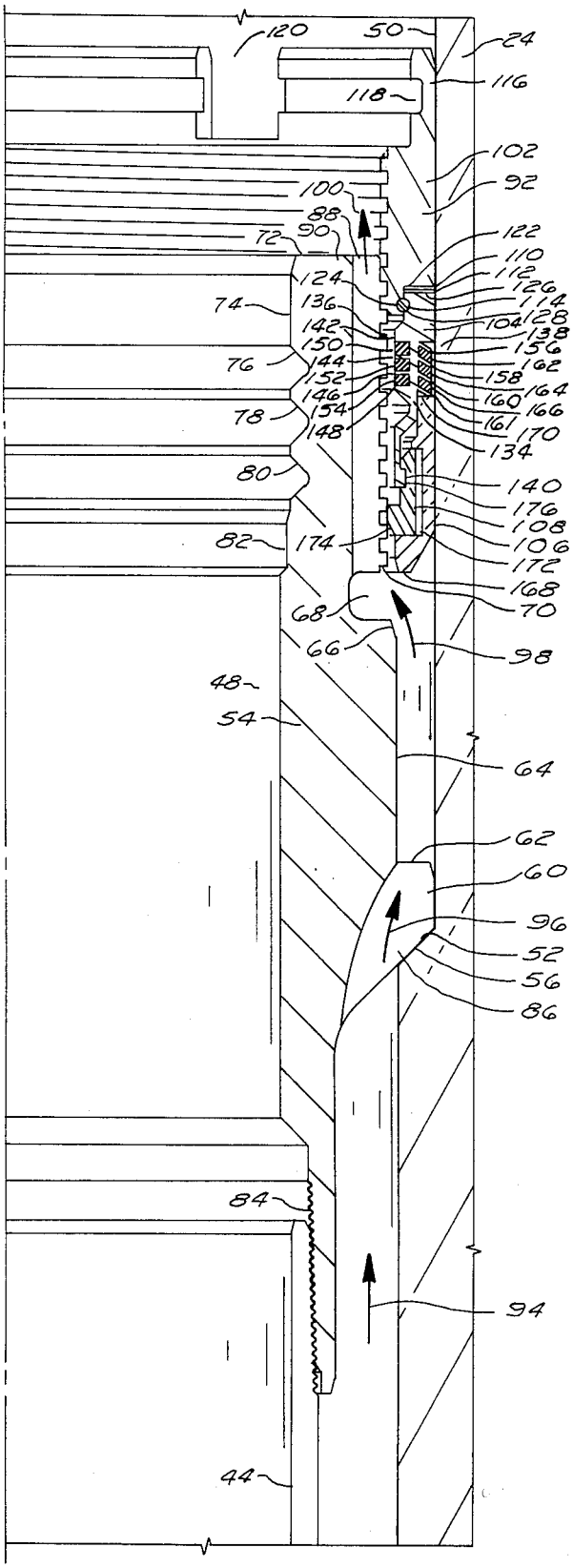

Referring now to FIG. 2, the wellhead 24 has a wellhead bore 50 and a lower shoulder 52 which suspends one or more casing hanger assemblies, such as casing hanger assembly 48. Casing hanger body 54 has a shoulder 56 which lands on lower shoulder 52 to allow the shoulder 52 in the wellhead to support the casing hanger body 54 and casing strings such as casing string 44.

The casing hanger body 54 provides a large diameter shoulder portion 60, a shoulder 62, a sealing diameter 64, a chamfer 66, an undercut groove 68, a male thread 70, an upper shoulder 72, an internal seal bore 74, grooves for engagement of running tools 76, 78, and 80, a second internal seal bore 82, and a lower casing thread 84. Additionally, casing hanger body provides a multiplicity of lower circulation grooves 86 which allow for circulation of well fluids past the shoulders 52 and 56 and a multiplicity of upper circulation grooves 88 which allow for circulation of well fluids past the threaded portion 90 of the casing hanger body 54 when the seal assembly 92 is in the upper position as is shown in FIG. 2.

When cement is circulated down the bore of the casing string 44 to cement the casing to the well bore 10, it causes a flow of the well fluids in the annular area between the casing string 44 and the well bore 10 up towards the surface. The lower circulation grooves 86 and the upper circulation grooves 88 provide a path for these fluids to flow past the casing hanger assembly 48 while the seal assembly 92 is in the position as is shown in FIG. No. 2. Arrows 94, 96, 98, and 100 illustrate the path of flow of well fluids past the casing hanger assembly 48 during this period.

The seal assembly 92 includes an upper section 102, a seal section 104, a nose section 106, and a release ring 108, bearing rings 110 and 112 between upper section 102 and seal section 104 to allow rotation, and ball bearings 114 between upper section 102 and seal section 104 to interconnect the two pieces.

The upper section 102 includes an upper running profile 116 which includes a locking groove 118 for being locked into by a running tool (not shown), a torque preparation 120 for receiving torque from said running tool, a shoulder 122 for contact of the bearing ring 110, and a semicircular groove 124 for receiving the ball bearings 114 which connect the upper section 102 to the seal section 104 and still allow relative rotation of the two pieces.

The seal section 104 includes an upper shoulder 126 for contact of the bearing ring 112, a semicircular groove 128 for receiving the ball bearings 114, a metal band 134 which passes from the top of the seal section to the bottom of the seal section, an internal seal preparation 136, an external seal preparation 138, and a lower shoulder preparation 140.

The metal band 134 provides a continuous connection between the top and the bottom of the seal section 104, yet is of a relatively thin cross section such as can be expanded or constricted with relative ease.

The internal seal preparation 136 includes a multiplicity of inner metal shoulders 142, 144, 146, and 148 extending from the metal band 134 to a diameter slightly larger than the sealing diameter 64. Between the inner metal shoulders 142, 144, 146, and 148 are resilient seal elements 150, 152, and 154 which are molded in place.

The external seal preparation 138 includes a multiplicity of outer metal shoulders 156 thru 161 which slope downwardly and outwardly. Between the outer metal shoulders 156 thru 161 are resilient seal elements 162 thru 166 which are molded in place.

The nose section 106 includes a lower shoulder 168 for striking the shoulder 62 of the casing hanger body 54, an upper shoulder 170 for loading against the external seal preparation 138, and an internal groove 172 for receiving the release ring 108.

The release ring 108 in machined to the approximate diameter as is shown on FIG. No. 2 and is saw cut in one place to allow easy diametrical expansion. In FIG. No. 2 it is approximately in contact with the outer diameter of male thread 70, which is of a smaller diameter than the sealing diameter 64. A chamfer 174 is provided on the lower end of the release ring 108 such that when it strikes the chamfer 66, it will be expanded to slide over the sealing diameter 64.

A locking groove 176 is provided to be engaged with the lower shoulder preparation 140 of the seal section 104 when the release ring 108 is in the position as is shown on FIG. No. 2. When the locking groove 176 is engaged with the lower shoulder preparation 140, the nose section is prevented from moving relatively toward the external seal preparation 138 to set the seal preparation.

When the chamfer 174 engages the chamfer 66 and the release ring 108 slides onto the sealing diameter 64, the release ring 108 will expand such that the locking groove 176 will be released from the lower shoulder preparation 140. At this time and when the nose section 106 strikes the shoulder 62, the nose section 106 can stop and the seal section 104 with the external seal preparation 138 can continue travelling down until the external seal preparation 138 is compressed and energized against the nose section 106.

Referring now to FIG. No. 3, the upper section 102 has been rotated to the right to cause downward movement of the seal assembly 92. The release ring 108 has been expanded by engagement with the chamfer 66 and the diameter 64 and has been thereby released from the lower shoulder preparation 140. When the nose section 106 contacted the shoulder 62, the nose section 106 and the release ring 108 became stationary and the other parts of the seal assembly 92 continued to travel downwardly.

When the external seal preparation 138 contacts the upper shoulder 170, further downward travel of the seal assembly 92 causes compression of external seal preparation 138, including the tendency of the of outer metal shoulders 142 thru 148 to be yielded to a more horizontal position as is shown in FIG. No. 3. As the outer metal shoulders assume a more horizontal position, they swing further from the metal band 134 and brinell or coin against and sealingly engage the wellhead bore 50.

Further, when external seal preparation 138 is compressed and is sealing against the wellhead bore 50, the pressure of this compression and the mechanical reaction of the outer metal shoulders 156 thru 161 against the wellhead bore 50 acts against the metal band 134 causing it to be constructed to a smaller diameter. This constriction of the metal band 134 causes the internal seal preparation 36 to be compressed against and to seal against the sealing diameter 64. The compression of internal seal preparation 136 against sealing diameter 64 provides metal sealing against the ends of inner metal shoulders 142 thru 148 and resilient sealing against resilient seal elements 150 thru 154.

The composite of the metal sealing of the shoulders and resilient sealing of the resilient seal elements on the outer diameter and the internal diameter of the seal section 104 against the wellhead bore 50 and the sealing diameter 64 of the casing hanger body 54 provide a highly reliable seal means against the flow as indicated by the arrows in the first direction as indicated by the arrows 94 thru 100 in FIG. No. 2 and against flow in the opposite direction.

During the setting process, the torque applied to the torque preparations 120 should be sufficient to generate a pressure in the external seal preparation 138 which is higher than the pressure which is expected to be sealed in the direction of the arrows as is shown in FIG. No. 2. As the cross sectional area of the external seal preparation 138 is substantially less than the cross sectional area of the complete seal section 104, the torque required to generate the pressure is considerably reduced as compared to the torque required directly set the entire seal area. Due to the nature of this invention, approximately the same pressure as is generated in the resilient seal elements of the external seal preparation 138 will be transmitted into the resilient seal elements of the internal seal preparation 136.

The present invention has enhanced sealing capabilities from the top side, in the direction opposite to the direction of the arrows on FIG. No. 2. This is appropriate to the present use of the invention, as in field operations, the higher pressure to be sealed is always expected from the top. The pressure from the top is imposed on the area between the wellhead bore 50 and the sealing diameter 64 and generates a downward force which is in proportion to that area and to the pressure from above. This downward force is resisted by the support of the seal section 104 loading on the upper shoulder 170 of the nose section 106. As the area of the upper shoulder 170 is considerably less than the area between the wellhead bore 50 and the sealing diameter 64, the pressure in the external seal preparation 138 is intensified by the approximate ratio of the areas. This intensified pressure is passed back thru the metal band 134 to the internal seal preparation 136.

Because of this seal intensification, a pressure from above, i.e. 10,000 p.s.i. can be resisted by a considerably higher pressure in the resilient seal means, i.e. 20,000 p.s.i., yielding a highly reliable seal mechanism which can be remotely set for subsea service.

Referring now to FIG. No. 4, the seal section portion of a seal assembly is illustrated with the alternate seal construction of having an all metal seal utilizing the operational characteristics of the present invention. It is identical in size to the seal section 104 of FIGS. 2 and 3; and can be used with the upper section 102 and the nose section 106.

The conical seal rings 200 are machined and stacked in place around the metal band 202 of the seal section 204. In this case 4 conical seal rings 200 are shown along with a single metal spacer ring 206. On the inner diameter of the seal section 204 are shown internal seal shoulders 208, 210, and 212 which are a series of rounded bumps.

Figure 3:
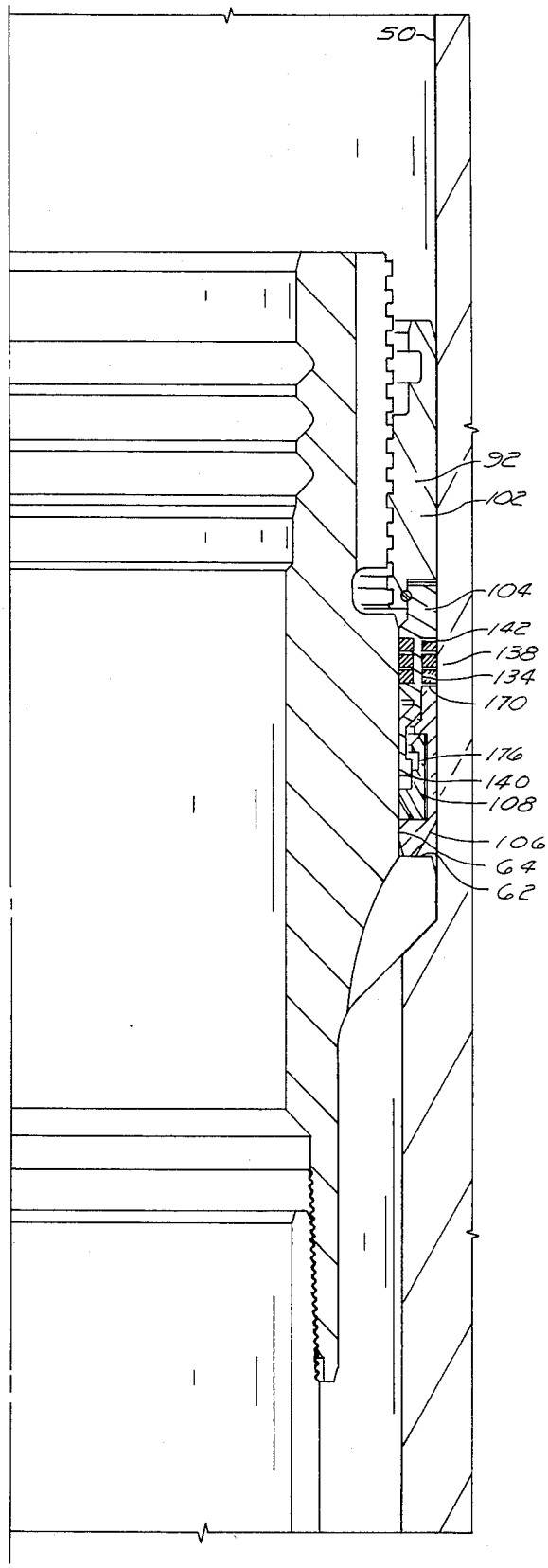

As this type seal assembly is moved to position as is shown on FIG. No. 3, the sealing action is similar to that of the embodiment as shown in FIGS. 2 and 3. The conical seal rings are flatten to a more horizontal position, extending their radial dimension. This extension of their radial dimension causes a sealing force against the wellhead bore 50 and a reaction force against the metal band 202. The reaction force against the metal band 202 causes the internal seal shoulders 208, 210, and 212 to be pressed against the sealing diameter 64 for sealing contact.

If resilient sealing is desired on the sealing diameter 64, a profile similar to that of FIG. No. 2 can be utilized. If resilient seal is desired against the wellhead bore 50, the metal spacer ring 206 can be replaced with a resilient member, or alternately a shorter resilient member can be placed between each of the conical seal rings 200 for a series of resilient seals.

The four conical seal rings 200 of FIG. No. 4 are assembled in a "parallel" style which means that as they move to the sealing position, the liquid volume between them will remain constant. This allows them to be fully energized to the horizontal position for full sealing capabilities. If instead the conical seal rings had been alternately reversed in their assembly process, it would be what is called a "series" style. In applications such as spring washers, the "series" style is useful as it gives a relatively low spring rate, whereas the parallel gives a relatively high spring rate. When the "series" style is utilized in sealing in a liquid filled environment as the subsea wellhead system will be, the bringing of the adjacent conical seal rings together traps a volume of liquid between them which as soon as an initial seal is achieved. This prevents the full movement of the seal rings to the horizontal position.

One of the desired features of this type seal is to put a substantial preload into the seal which means that after the initial seal is achieved, further preloading is desired. In the case of the "series" stacked seal, as soon as the initial seal is achieved, further preloading is stopped, leaving the unit subject to failure in field conditions which typically vary both the temperature and pressure of the sealing environment.

The foregoing disclosure and description of this invention are illustrative and explanatory thereof, and various changes in the size, shape, and materials, as well as the details of the illustrated construction may be made without departing from the spirit of the invention.

I claim:

1. In a subsea wellhead providing a support shoulder and a generally cylindrical seal bore with a casing hanger supported on said support shoulder within said wellhead, said casing hanger providing an external seal diameter and a stop shoulder spaced below said external seal diameter, said cylindrical seal bore and said external seal diameter being concentric and spaced apart and providing an annular gap therebetween, a seal assembly comprising, a seal element of a radial cross section to fit within said annular gap, comprising an upper section, a nose section, a seal section, a connection between said upper section and said seal section, and a connection between said seal section and said nose section, said upper section being adapted to transmit a setting and retaining force to the seal section, said nose section being adapted to land on said stop shoulder and having an upper shoulder, said seal section comprising a continuous metal band centrally located within said annular gap, an external seal preparation located around said metal band, and an internal seal preparation within said metal band, said metal band providing a metal connection between the top end of said seal section and the bottom of said seal section, said internal seal preparation comprising at least one inner metal seal area adapted to be pressed against and to seal against said external seal diameter, with said external seal preparation comprising at least one outer metal shoulder which slopes downwardly and outwardly and said at least one outer metal shoulder of said external seal preparation landing on said upper shoulder of said nose section upon downward movement of said seal section after said nose section has landed on said stop shoulder, such landing and contact between said at least one outer metal shoulder of said external seal preparation and said upper shoulder causing said at least one outer metal shoulder to be moved to a more horizontal position and thereby extending the radial component of said at least one outer metal shoulder causing the outer end of said at least one outer metal shoulder to contact said cylindrical seal bore of said subsea wellhead for sealing thereupon and for providing a reaction force in the direction opposite to the contact on the cylindrical seal bore of said wellhead to provide a compressive loading and constrict the diameter of said metal band and thereby press said at least one inner metal seal area against said external seal diameter on said casing hanger for sealing thereupon.

2. The invention of claim 1, wherein there are a minimum of two inner metal shoulders and a minimum of two outer metal shoulders and resilient seal elements are added between the minimum of two inner metal shoulders and resilient seal elements are added between the minimun of two outer metal shoulders to provide a combination of metal to metal sealing and resilient sealing.

3. The invention of claim 1, wherein said nose section includes an internal groove, said seal section includes a lower shoulder, and a release ring is included which fits into said internal groove in said nose section and engages said lower shoulder of said seal section; said seal section being prevented from moving downwardly relative to said nose section when said release ring is engaged with said lower shoulder and said seal section being allowed to move downwardly relative to said nose section when said release ring is expanded and thereby released from said lower shoulder.

4. The invention of claim 3, wherein said expanding of said release ring occurs when said release ring is expanded over said external seal diameter.

5. The invention of claim 1, wherein said setting and retaining force which is transmitted to said seal section is generated by rotational torque applied to the upper section which has a female thread which engages a male thread on said casing hanger.

6. The invention of claim 1, wherein said at least one outer metal shoulder of said external seal preparation is moved from a non-sealing position to a sealing position in a parallel motion thereby preventing a liquid locking condition from occurring, which prevents the full setting action of the external seal preparation.

7. In a subsea wellhead providing a support shoulder and a generally cylindrical seal bore with a casing hanger supported on said support shoulder within said wellhead, said casing hanger providing an external seal diameter and a stop shoulder spaced below said external seal diameter, said cylindrical seal bore and said external seal diameter being concentric and spaced apart and providing an annular gap therebetween, a seal assembly comprising, a seal element of a radial cross section to fit within said annular gap, comprising an upper section, a nose section, a seal section, a connection between said upper section and said seal section, and a connection between said seal section and said nose section, said upper section being adapted to transmit a setting and retaining force to the seal section, said nose section being adapted to land on said stop shoulder and having an upper shoulder, said seal section comprising a continuous metal band within said annular gap, an external seal preparation located around said metal band, and an internal seal preparation located within said metal band, said metal band providing a metal connection between the top end of said seal section and the bottom of said seal section, said internal seal preparation comprising at least one inner metal seal area adapted to be pressed against and to seal against said external seal diameter, with said external seal preparation comprising at least one conical seal ring and the lower portion of said at least one conical seal ring landing on said upper shoulder of said nose section upon downward movement of said seal section after said nose section has landed on said stop shoulder, such landing and contact between said at least one conical seal ring of said external seal preparation and said upper shoulder causing said at least one conical seal ring to be moved to a more horizontal position and thereby extending the radial component of said at least one conical seal ring causing the outer end of said at least one conical seal ring to contact said cylindrical seal bore of said wellhead for sealing thereupon and for providing a reaction force in the direction opposite to the contact on said cylindrical seal bore of said subsea wellhead to provide a compressive loading and constrict the diameter of said metal band and thereby press said at least one inner metal seal area against the external diameter on said casing hanger for sealing thereupon.

8. The invention of claim 7, wherein at least one resilient insert is provided for at said least one conical seal ring of said external seal preparation to provide at least one resilient seal between said metal band and said wellhead bore when said at least one seal ring is moved to a sealing position.

9. The invention of claim 7, wherein said nose section includes an internal groove, said seal section includes a lower shoulder, and a release ring is included which fits into said internal groove in said nose section and engages said lower shoulder of said seal section; said seal section being prevented from moving downwardly relative to said nose section when said release ring is engaged with said lower shoulder and said seal section being allowed to move downwardly relative to said nose section when said release ring is expanded and thereby released from said lower shoulder.

10. The invention of claim 9, wherein said expanding of said release ring occurs when said release ring is expanded over said external seal diameter.

11. The invention of claim 7, wherein said setting and retaining force which is transmitted to said seal section is generated by rotational torque applied to the upper section which has a female thread which engages a male thread on said casing hanger.

12. The invention of claim 7, wherein said at least one conical seal ring of said external seal preparation is moved from a non-sealing position to a sealing position in a parallel motion thereby preventing a liquid locking condition from occurring, which prevents the full setting action of the external seal preparation.

13. In a subsea wellhead providing a support shoulder and a generally cylindrical seal bore with a casing hanger supported on said support shoulder within said wellhead, said casing hanger providing an external seal diameter and a stop shoulder spaced below said external seal diameter, said cylindrical seal bore and said external seal diameter being concentric and spaced apart and providing an annular gap therebetween, a seal assembly comprising, a seal element of a radial cross section to fit within said annular gap, comprising an upper section, a nose section, a seal section, a connection between said upper section and said seal section, and a connection between said seal section and said nose section, said upper section being adapted to transmit a setting and retaining force to the seal section, said nose section being adapted to land on said stop shoulder and having an upper shoulder, said seal section comprising a continuous metal band within said annular gap, an external seal preparation located around said metal band, and an internal seal preparation located within said metal band, said metal band providing a metal connection between the top end of said seal section and the bottom of said seal section, said internal seal preparation comprising at least one inner metal seal area adapted to be pressed against and to seal against said external seal diameter, with said external seal preparation comprising a multiplicity of conical seal rings and the lower portion of one of said conical seal rings landing on said upper shoulder of said nose section upon downward movement of said seal section after said nose section has landed on said stop shoulder, such landing and contact between the lower portion of one of said conical seal rings of said external seal preparation and said upper shoulder causing said conical seal rings to be moved to a more horizontal position and thereby extending the radial component of said conical seal rings causing the outer ends of said conical seal rings to contact said cylindrical seal bore of said wellhead for sealing thereupon and for providing a reaction force in the direction opposite to the contact on said cylindrical conical seal bore of said subsea wellhead to provide a compressive loading and constrict the diameter of said metal band and thereby press said at least one inner metal seal area against the external diameter on said casing hanger for sealing thereupon.

14. The invention of claim 13, wherein resilient inserts are placed between said conical seal rings of said external seal preparation to provide resilient seals between said metal band and said wellhead bore when said conical seal rings are moved to a sealing position.

15. The invention of claim 13, wherein said nose section includes an internal groove, said seal section includes a lower shoulder, and a release ring is included which fits into said internal groove in said nose section and engages said lower shoulder of said seal section; said seal section being prevented from moving downwardly relative to said nose section when said release ring is engaged with said lower shoulder and said seal section being allowed to move downwardly relative to said nose section when said release ring is expanded and thereby released from said lower shoulder.

16. The invention of claim 15, wherein said expanding of said release ring occurs when said release ring is expanded over said external seal diameter.

17. The invention of claim 13, wherein said setting and retaining force which is transmitted to said seal section is generated by rotational torque applied to the upper section which has a female thread which engages a male thread on said casing hanger.

18. The invention of claim 13, wherein said conical seal rings of said external seal preparation are moved from a non-sealing position to a sealing position in a parallel motion thereby preventing a liquid locking condition from occurring between said conical seal rings, which prevents the full setting action of the external seal preparation.

* * * * *

UNITED STATES PATENT AND TRADEMARK OFFICE

CERTIFICATE OF CORRECTION

PATENT NO. : 4,781,387

DATED : November 1, 1988

INVENTOR(S) : Benton F. Baugh

It is certified that error appears in the above-identified patent and that said Letters Patent is hereby corrected as shown below:

Title page under United States Patent Item (19), "Braugh" should read -- Baugh -

Signed and Sealed this

Twenty-eighth Day of March, 1989

*Attest:*

DONALD J. QUIGG

*Attesting Officer*

*Commissioner of Patents and Trademarks*